US008671869B2

(12) United States Patent
Müller

(10) Patent No.: US 8,671,869 B2
(45) Date of Patent: Mar. 18, 2014

(54) SEGMENTED PLATFORM

(76) Inventor: Peter A. Müller, Gattikon (CH)

( * ) Notice: Subject to any disclaimer, the term of this patent is extended or adjusted under 35 U.S.C. 154(b) by 451 days.

(21) Appl. No.: 12/734,577

(22) PCT Filed: Nov. 12, 2008

(86) PCT No.: PCT/CH2008/000478
§ 371 (c)(1),
(2), (4) Date: Sep. 29, 2010

(87) PCT Pub. No.: WO2009/062331
PCT Pub. Date: May 22, 2009

(65) Prior Publication Data

US 2011/0017122 A1 Jan. 27, 2011

(30) Foreign Application Priority Data

Nov. 12, 2007 (CH) ..... 1745/07

(51) Int. Cl.
*B63B 27/14* (2006.01)
*B63B 17/00* (2006.01)

(52) U.S. Cl.
USPC ..... 114/362

(58) Field of Classification Search
USPC ..... 114/343, 362, 365, 368–374; 14/69.5, 14/71.1–71.7; 182/1, 83–86
See application file for complete search history.

(56) References Cited

U.S. PATENT DOCUMENTS

| | | | | | |
|---|---|---|---|---|---|
| 4,168,764 | A * | 9/1979 | Walters | ..... | 182/1 |
| 4,971,168 | A * | 11/1990 | Stanescu | ..... | 182/1 |
| 7,121,226 | B2 * | 10/2006 | Grimaldi | ..... | 114/362 |
| 7,159,261 | B2 * | 1/2007 | Carrigan | ..... | 14/71.1 |
| 2006/0075952 | A1 | 4/2006 | Grimaldi | | |

FOREIGN PATENT DOCUMENTS

| | | | | | |
|---|---|---|---|---|---|
| DE | 199 63 057 | C1 | | 12/2000 | |
| EP | 1 616 782 | A1 | | 1/2006 | |
| EP | 1854715 | A1 | * | 11/2007 | ..... B63B 27/14 |
| FR | 2 878 822 | A | | 6/2006 | |
| JP | 05098610 | A | * | 4/1993 | ..... E01D 13/00 |
| JP | 2005161952 | A | * | 6/2005 | ..... B63B 27/14 |
| MX | PA02011583 | A | | 5/2004 | |

* cited by examiner

*Primary Examiner* — Ajay Vasudeva
(74) *Attorney, Agent, or Firm* — Oliff PLC

(57) ABSTRACT

The invention comprises a segmented plate (1) for watercraft which is able to be swivelled into a stair lift, swimplatform or gangway by means of an active cylinder (4), or passive cylinder (44). The plate (2) consists of segmented strips (5), which have flexible elements (19) or are releasable and equipped with sensors (13), so that in case of bending or releasing of a segmented strip (5), on the grounds of a foreign element (15) trapped into the segmented strip (5), the cylinder (4) is stopped by means of the controller (14). Contact bands (16) and light strips (17) and cover (11) additionally increase the safety of the swivelable plate (2).

12 Claims, 5 Drawing Sheets

SEGMENTED PLATFORM

This application claims priority of PCT application PCT/CH2008/000478 having a priority date of Nov. 12, 2007, the disclosure of which is incorporated herein by reference.

TECHNICAL FIELD

The invention is based on a segmented plate which can be used as a stair lift, gangway and swimplatform and preferably can be attached to the stern of a watercraft, quasi self-supporting, but with a safety support and inclination mean by way of an adequately placed cylinder, whereby the segmented plate elements and the shifting mechanism have safety means, which are in a position to eliminate cutting, bruising and any other form of injury.

BACKGROUND OF THE INVENTION

Fixed swimplatforms are known in the boating sector, onto which mainly manual mostly telescopic fold out ladders can be fixed, as described in EP patent 1 616 782 A 1, on ships lowerable stairs are known, which accomplish their task hydraulically and also with a cable winch, as described in patent MXPA 0201 1583. On recreational motor yachts lowerable ladders as well as stairs with horizontal fixed steps are in use by means of hydraulic or electric cylinders. These enable passengers and animals to access comfortably into the water. On large ships such stairs serve as a way of reaching land. The motorized ladders and stairs are placed directly in the watercraft- or in swimplatform boxes and are horizontally extended, thereafter inclined towards the water by a hinge, as described in patent FR 2878822. In many cases the lowering is achieved by means of an additional cylinder. A combination with a fixed swimplatform and movable stair elements is known in US patent 2006/0075952 A1 which is inclinable, but without safety means to prevent cuts and bruising from the stair elements. Known too are dropdown swimplatforms which can be lowered up to below the waterline especially for retrieval of dinghies and jetskis as described in patent DE 199 63 057 C1.

SUMMARY OF THE INVENTION

The invention involves the fixation of a segmented plate placed at the stern of a watercraft, which has the function of a swimplatform, a drop down stairway and a lifting up gangway, whereby the segmented plate elements, as well as the entire mechanism, prevents and protects limbs or other objects getting trapped. In addition it is possible to use the swimplatform with its stair function as such to be lowered but as well by optional mean as well with a lifting sledge to pick up tenders or similar mean. The stair function also allows the inclination in a lifting sense, similar to a gangway so that an elevated pier or quay can be easily reached on foot and additionally as an option, one or more plate elements may be driven out.

More boats and yachts are being equipped at the stern with swimplatforms or stairs, for one reason to get closer to the water by means of such swimplatform or to fix on waterskis easier, or another reason to reach the boat or yacht from the water by stairs mean. Most swimplatforms have pull out stairs so that one can get into or out of the water more easily. Dropdown swimplatforms are quite a luxury but very convenient and are mostly purchased in connection with a lift function for a dinghy.

The invention has the advantage of having a swimplatform, with all the benefits only usually found on large yachts, which means, having extendable and inclinable stairs with stair steps which remain constantly horizontal, incorporated into an elegant, space saving and simple device, with special attention being given to the safety of persons and to the mechanism. Thereby all the functions and uses of a swimplatform are kept in function, such as the comfortable horizontal stair steps are easy to be walked on and have a high standard of safety and can even be used when the stair is in motion. As the stair steps are difficult to see underwater, the movable parts of the mechanism have been covered accordingly to avoid cutting and injury risks, the stair steps have releasable mean according to force and its direction or can be flexible on one side and may be equipped with a indication sensor and stop controller, so that when using the stair, no limbs or other foreign elements can be injured or damaged should they get stuck between the stair and swimplatform, nor will any mechanical part be negatively affected.

In the swimplatform position the singular plate elements are locked into the park position, so to avoid loosening or rattling noise of the steps due to wave motion or other influences.

The swimplatform with the stair function may also have rail elements so that e.g. a tender can be picked up by means of a cart and thereafter it can be moved manually or by means of a motor to the stern or directly into a garage.

In addition the swimplatform with its stair function is not only focused on lowering elements but also to getting them into the lifting position, as such to be used as a gangway, particularly in connection with the extendable, additional plate elements and the suspension, respectively with its shock absorbing function of the lifting mechanism in case of impact on the pier or quay.

The lifting movement to transform the swimplatform into a dropdown stair or gangway is achieved by means of either an active cylinder, e.g. a hydraulic-, pneumatic- or electric cylinder or by means of a passive cylinder which represents a gas spring.

Quintessence of the invention is the fixation onto the stern of a watercraft of a swimplatform with a stair function with a high safety standard, which is lowerable or liftable, by means of an active or passive cylinder equipped with means to hide slits, with releasable or one-sided flexible steps, with one or more contact sensors with stop actuator and additional safety and locking mean.

BRIEF DESCRIPTION OF THE DRAWINGS

Various exemplary aspects of the invention will be described with reference to the drawings wherein It shows FIG. 1 A schematic sideview of a segmented plate which can be used as a swimplatform, stair or gangway onto which a cylinder is fixed and an extendable stanchion FIG. 2 A schematic sideview of a segmented plate with single releasable elements and an extendable element FIG. 3 A schematic sideview of a segmented plate with single flexible elements FIG. 3*a* A schematic sideview of a flexible element with a sensor and a controller FIG. 4 A schematic sideview of dual releasable elements equipped with sensors and a controller FIG. 5 A schematic sideview of a segmented plate with arched elements in three different lifting positions FIG. 5*a* A schematic sideview of variable conical elements with hinges and inboard pressure springs FIG. 6 A schematic sideview of a segmented plate in the gangway position, with folded out extendable part, with pressure sensor, hydraulic and controller mean, as well as the inclusion of an external trim sensor FIG. 7 A schematic sideview of a segmented plate with single releasable elements and an active locking mechanism FIG. 8 A schematic sideview of a segmented plate with single releasable elements and a passive locking mechanism FIG. 9 A schematic sideview of a segmented plate with a tender cart on rails with stroke locking mean FIG. 10 A schematic sideview of a segmented plate of a height adjustable swimplatform, enabled to be driven out and inclined FIG. 11 A schematic sideview of a segmented plate which has a gas spring with a manual trigger and a torsion tube Only essential elements of the invention are schematically shown to facilitate immediate understanding.

DETAILED DESCRIPTION OF EMBODIMENTS

Figure 1:
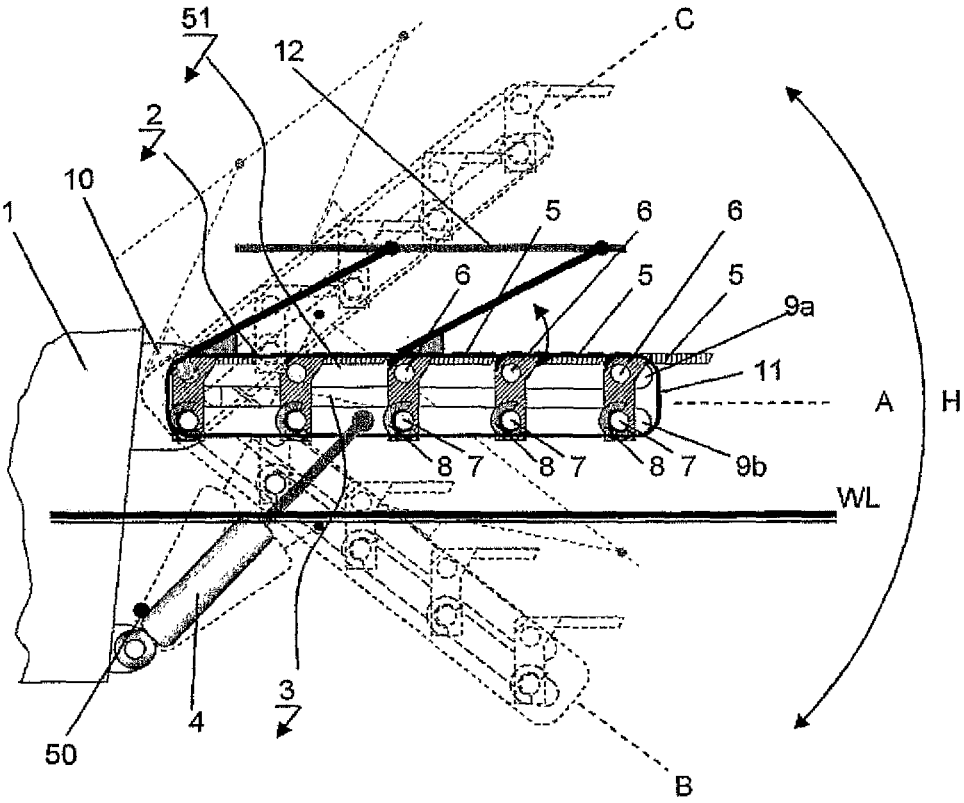

FIG. 1 shows a schematic sideview of an overhanging segmented plate 2 positioned on the stern 1 of a watercraft consisting of several segmented strips 5 and their safety mean 51, which is supported by a vario mean 3 and by means of a cylinder 4 allows a lowering or lifting of vario mean 3. The segmented plate 2 in the horizontal swivel position A can be used as a swimplatform or in the lowered swivel position B as a stair to the water or under the waterline WL or when swivelled in the upward position C as gangway to enable easy access to the pier or landing quay The segmented plate 2 consists of segmented strips 5, which when aligned next to each other form a flat plate, whereby the segmented strips 5 by means of rotation axis 6 are rotatable embedded and the mounted cams 7 are held in a clip holder 8, which is positioned onto vario mean 3, Through the cylinder movement H of the vario mean 3 the segmented strips 5 remain horizontal as the vario mean 3 forms a parallelogram in this example, by means of swivel arms 9*a*,9*b*, which are hinged on to console 10 and console 10 is mounted on stern 1. The horizontal positioning of segmented strips 5 on vario mean 3 can also be achieved by other means, as for example by means of a stepped motor in which the angle of the vario mean 3 mean is measured and the segmented strips 5 adjusted accordingly. It is also possible that with a forced adjustment gear or belt drive the segmented strips 5 can be held in the required position, whereby all have in common that the segmented strips 5 when being exposed to a particular force for example when a foreign element gets into the mechanism this results in that the segmented strips 5 come loose from the rotation axis fixation and consequently the cylinder movement is immediately stopped. The segmented strips 5 can also contain other safety elements. The protection mechanism relates on the one hand to the movable segmented strips 5, on the other hand to both of the swivel arms 9*a*,9*b*, which with a cylinder movement over stroke H, the distance of the swivel arms 9*a*,9*b* change to each other and so by means of cover lid 11 are totally covered.

The cylinder 4 supports plate 2 in such a way it stays tight in rough seas in the normal swivel position A, even when an object is fixed onto it or also in the stair function the mechanism is kept secure in rough seas by the corresponding support by means of cylinder 4. Cylinder 4 can be propped up either directly on the stern 1 or on the correspondingly formed console 10. To avoid an undesired lowering of cylinder 4, a lifting locker mean 50 is installed, which can contain, in the case of a hydraulically driven cylinder 4 for example a locking valve, with an electric cylinder 4 a self locking spindle and with a gas spring a gas locking element or can be equipped with an additional mechanical lock, as for e.g. a mechanical lock between plate 2 and stern 1. Together with these locking devices provision is made for an additional safety mean 51 regarding the swivelling and segmented plate 2. The safety means 51 include besides the release function, the following described flexible elements, electronic mean and others, whereby not all must be implemented simultaneously in the corresponding various shaped segmented strips 5.

On vario mean 3 is additionally an extendable stanchion 12 to enable bathing guests to enjoy the convenient stair as well as the gangway function, which also adds to the safety especially in rough sea.

Figure 2:
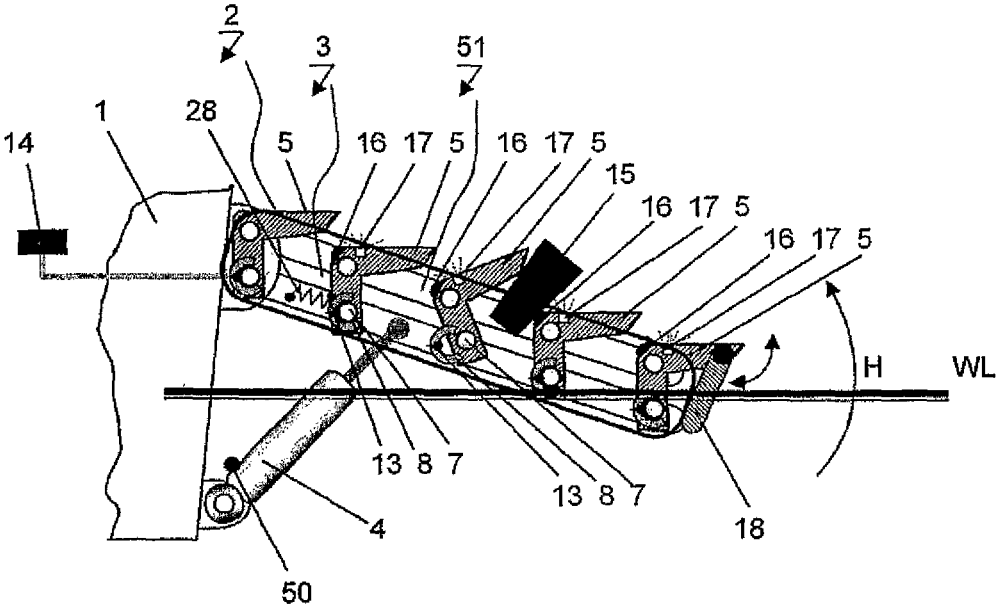

FIG. 2 Shows a schematic sideview of a segmented plate 2 with the individual releasable segmented strips 5. The segmented strips 5 are hinged, by means of rotation axis 6 and fixed to the swivel arm 9*a*, can be released by means of cams 7 held in the clip holder 8, and the clip holder 8 is fixed to swivel arm 9*b*. This simple geometry in connection with a parallelogram as shown here as vario mean 3, always keeps the segmented strips 5 horizontal. The clip holder 8 is preferably made out of plastic with an appropriate spring indicator and has a sensor 13, which is connected to the controller 14. In case of contact loss at the sensor 13 a stop order is transmitted to cylinder 4. This function is imperative as should a limb, foot or hand or another foreign element 15 be between the segmented strips 5, exactly when the vario mean 3 moves upwards, then the distance from segmented strip 5 to segment strip 5 always gets smaller resulting in a massive entrapment or more serious injury. On the grounds of the increasing pressure on the corresponding segmented strips 5, the cam 7 springs out of the clip holder 8 and gives room for the foreign element 15, simultaneously, due to the contact loss on sensor 13, stroke movement H is immediately stopped by controller 14. By means of spring 28, shown here only in one place, the segmented strip 5 is brought back to its original position as soon as the problem with the foreign element has been resolved.

An additional safety is the contact band 16. In the case of too high pressure on the contact band 16, the cylinder 4 will also be immediately stopped by controller 14. As the contours in stirred water are not clearly visible under the waterline WL, then a visual aid can be implemented, so that with the help of light strips 17 the person can visually see where the borderlines for hands and feet are. A visual strip also has the advantage that by night an interesting additional illumination is visible on the stern 1.

In addition on one of the segmented strips 5, generally on the last segmented strip 5, is a extendable part 18, which enables a jetski due to the added support surface to be raised and then to be lowered into the water in a safer and more comfortable manner. A first larger pick up area in form of an extendable part 18 together with the segmented strips 5, enables a more comfortable and safer coming on board.

Such extendable parts 18 can also be placed in another location, so that when in the stair mode the bathing guests can rest on such enlarged areas so as to be closer to the water or even partly sit in the water. Cupholder and other add-ons allow longer enjoyment.

Figure 3:
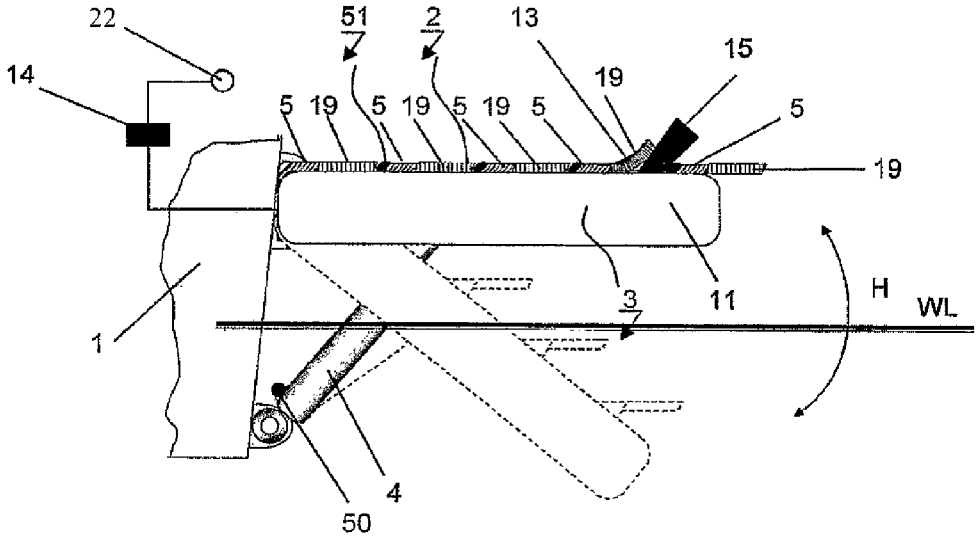

FIG. 3 Shows a schematic sideview of a segmented plate 2 with the separate segmented strips 5 which show flexible elements 19. Should a foreign element 15 accidentally get blocked between the segmented strips 5 when lifting up the vario mean 3 with its cover over stroke H, stroke H of cylinder 4 is then immediately stopped by signalisation of the sensor 13 to the controller 14.

In case of long period of non operation time of the watercraft and in case a foreign element 15 gets caught into the segmented strips 5 and in case one tries to lower the segmented plate 2 with the vario mean 3, then the process remains inactive, as e.g. woody debris is blocking and a lowering of the segmented strips 5 would cause damage to the mechanism. A jumper switch 22 permits cylinder 4 at own responsibility to become activated despite lack of contact of sensor 13.

Figure 3A:
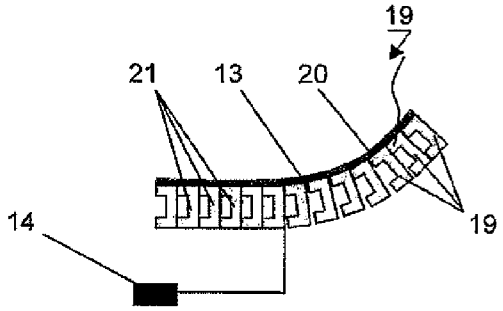

FIG. 3*a* Shows a schematic sideview of a flexible element 19. This has an overhead, elastic walkable surface 20, under which rigid segments 21 are fixed and are not stuck or glued to each other, whereas every segment 21 has a direct contact with the surface 20, therefore every segment 21 supports another segment 21 and thereby prevents a bending or buckling of the elastic surface 20. The flexible element 19 has a sensor 13, which can be for example a strain gauge, an optical transmitter or sensor device so that by a deformation of the shape of the surface 20 the sensor 13 transmits the signal to the controller 14 and thereafter the cylinder 4 will be stopped immediately.

Figure 4:
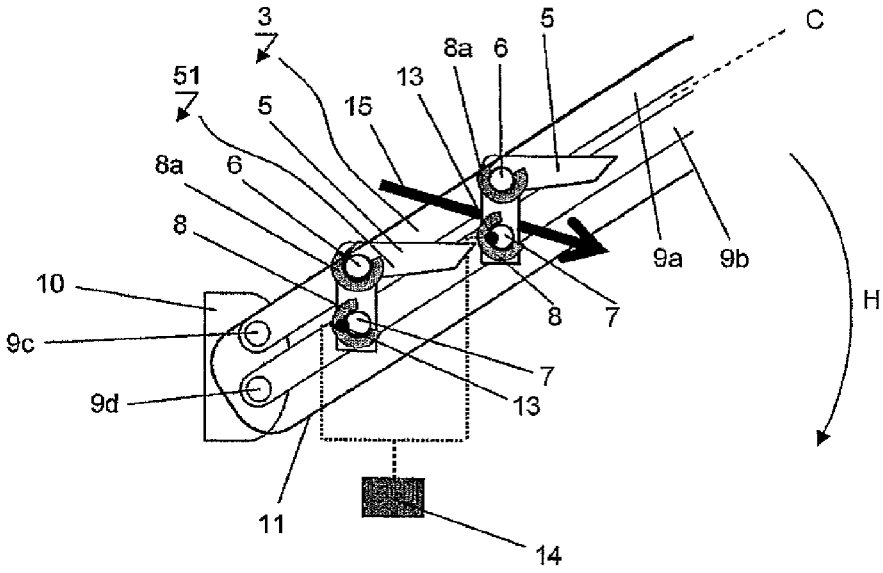

FIG. 4 Shows a schematic sidewiew of releasable segmented strips 5 especially for the upward swivel, i.e. in swivel position C which has an additional releasable clip arm. The swivel arms 9*a*, 9*b* fixed to the console 10 by means of pivot bearings 9*c*, 9*d*, create a parallelogram and on the grounds of this parallelogram's geometry, that whilst the vario mean 3 swivels upward, the segmented strips 5 continually come closer and are in the swivel position A then finally lying side by side. Hence the segmented strips 5 can be released from the opposite side, too, i.e. in case a foreign element 15 is situated between the segmented strips 5 during the stroke movement H, both clip holders 8 and 8*a* are active, the segmented strip 5 clips out and sensor 13 reports the contact loss to the controller 14 and gives the order to stop stroke H immediately. Therewith the high safety standard remains preserved.

Figure 5:
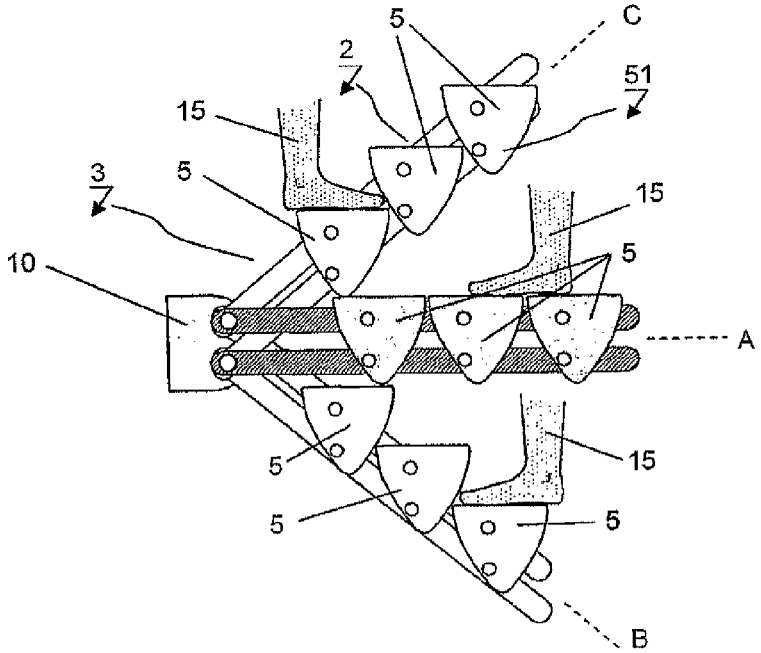

FIG. 5 Shows a schematic sideview of a segmented plate 2 with arched segmented strips 5, exemplary in three lifting positions C,A,B. For yachts with sufficient room under a horizontal held plate 2 fully enclosed segmented strips 5 can therefore be ideally introduced, so that a foreign element 15 for example a foot can never get under or between the segmented strips 5 even if the vario mean 3 is swivelled upwards in swivel position C or downwards in swivel position B. In swivel position A the segmented strips 5 are able to be walked upon normally and therefore the one or the other safety measure can be left out, whereas the cover 11, in the case of the use of a parallelogram with swivel arms 9*a*,9*b* remains in force.

Figure 5A:
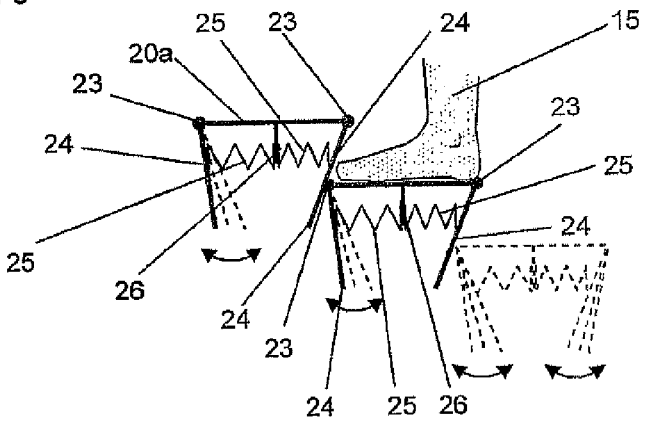

FIG. 5*a* Shows a schematic sideview of a segmented plate 2 with variable conical segmented strips 5, exemplary in a stepped position. On the grounds of the arched stroke H of vario mean 3 the distance from segmented strip 5 to the segmented strip 5 changes according to the swivel position. So that the segmented strips 5 stay gap free to each other, the segmented strips 5 each have a hinge 23 on the two side surface edges 20*a* which support the side covers 24. Under the surface 20*a* are pressure springs 25 which are pressing against fin 26. Therefore it is ensured that the side cover 24 of a segmented strip 5 always fits closely against the opposite lying segmented strip 5.

Figure 6:
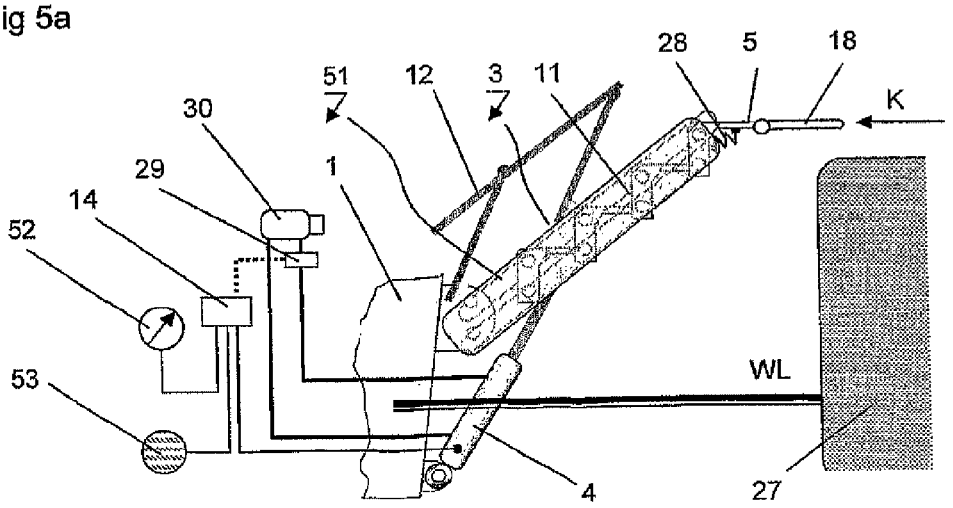

FIG. 6 Shows a schematic sideview of a segmented plate 2 in the swivel position C which can be ideally used as gangway with the extendable part 18 folded out, whilst the last segmented strip 5 can be fitted on a quay 27 at low or high tide. Should, due to lack of attention or wave flow, the vario mean 3 with its segmented strip 5 hit against quay 27, the system will not be damaged as the segmented strip 5, by means of the rotation axis 6, cams 7 and clip holder 8 releases itself. As soon as the problem no longer exists, the extendable part 18, respectively the segmented strip 5 goes back to its original position by means of spring's 28 spring effect.

If the release is registered in the controller 14 by sensor 13, then the cylinder 4 extends to a given stroke position, until no more release of segmented strip 5 is registered. It is feasible to equip the whole system with a proximity sensor and to transmit the signal to the controller 14, which then activates cylinder 4 accordingly. Should the segmented strip 5, respectively the extendable part 18, be hit from the front side, in accordance with arrow K, then an over-pressure valve 29 on the hydraulic pump 30 gets activated and gets the hydraulic medium out of the cylinder, in the case of an electric motor it would be a freewheel element so that the cylinder does not remain immovable and gets damaged or the whole unit would suffer because of this. The over-pressure valve reports the actual status to the controller 14 and gives the command to extend the cylinder 4 so as to avoid damage.

This configuration is also suitable for a possible stair modus. If the plate 2 is in the swivel position B and if the, not shown here, stern drive is tilted up, it would hit against the torsion tube 49 which is described further down and thus activate the over-pressure valve. In addition, an alarm 53 would draw attention to the problem. The trim indicator 52, possibly a potentiometer, as found on most stern drives, can also be used to report the actual signal to the controller 14, so as to prevent the stern drive in such a case from being tilted up or to block the stair function should the stern drive have already been lifted.

Figure 7:
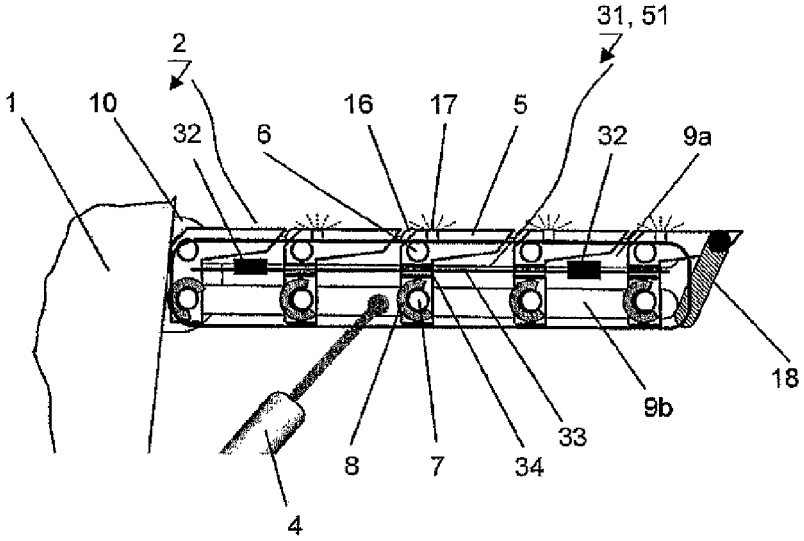

FIG. 7 Shows a schematic sideview of segmented plate 2 with single releasable segmented strips 5 with an active locking mechanism 31, consisting of a trigger 32 which pushes a locking rod 33 into the locking mean 34. This function is advisable as soon as the plate 2 is locked in the swivel position A so that waves cannot release segment strips 5 or do not rattle while driving due to the pounding on the watercraft's hull. The cylinder 4 cannot be activated as long as the active locking mechanism 31 is active.

Figure 8:
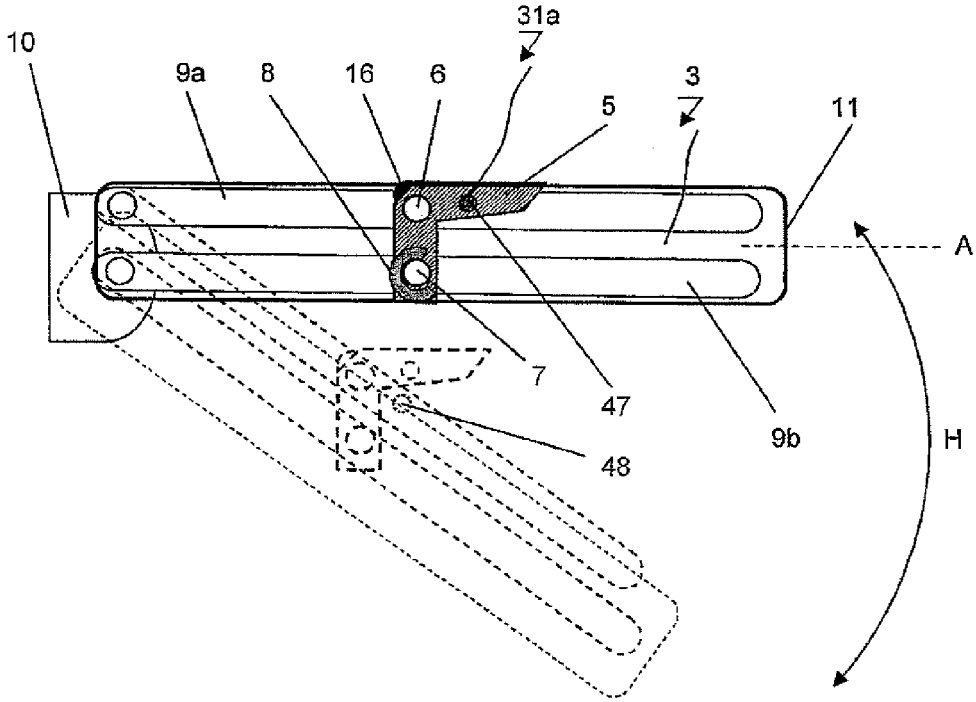

FIG. 8 Shows a schematic sideview of segmented plate 2 with the single releasable segmented strips 5 with a passive locking mechanism 31*a*, consisting of a spring loaded ball 47 and the ball pick up 48, which is a pit in swivel arm 9*b*. The passive locking mechanism 31*a* should only just hold the segmented strips 5 at the horizontal swivel position A in order to prevent having a rattling or in heavy seas not to have the risk that the segmented strips 5 release. The spring loaded balls 47 in the segmented strips 5 therefore press themselves into the pit of the ball pick up 48 which are in the swivel arm 9*b* and hold them in position to an adjustable pressure. Should the cylinder 4 drive in or out, the vario mean 3 is swivelled accordingly with the result that the spring loaded ball 47 leaves the pit of the pick up 48 and thereby the segmented strip 5 is able to be released normally.

Figure 9:
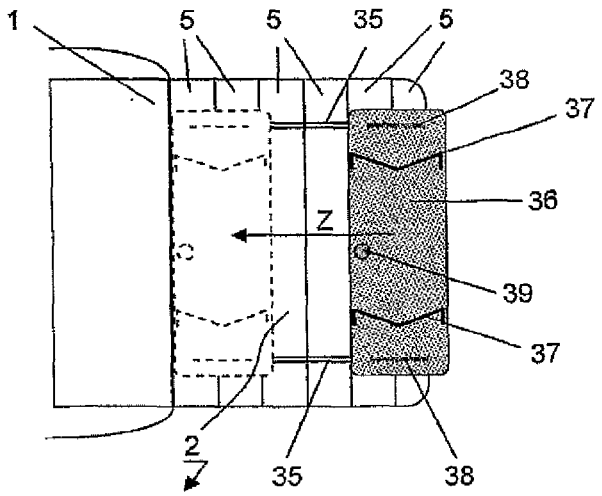

FIG. 9 Shows a schematic sideview of a segmented plate 2 with incorporated rail elements 35 on the segmented strip 5. A tender cart 36 with carrying mean 37 can be placed safely onto the rail elements 35 despite sea waves and in the event vario mean 3 has driven the segmented strips 5 downwards, a dinghy can be placed on the tender cart 36. Thereafter the vario mean 3 can be lifted up to swivel position A so that the rail elements 35 run horizontally and the tender cart 36 can be driven manually or motorized according to arrow Z towards stern 1. For this shifting operation sliding elements 38, which can be pulleys or gliding elements, are situated under the tender cart 36. By means of the tender cart lock mechanism 39 the tender cart 36 can be firmly locked into the appropriate park position.

Figure 10:
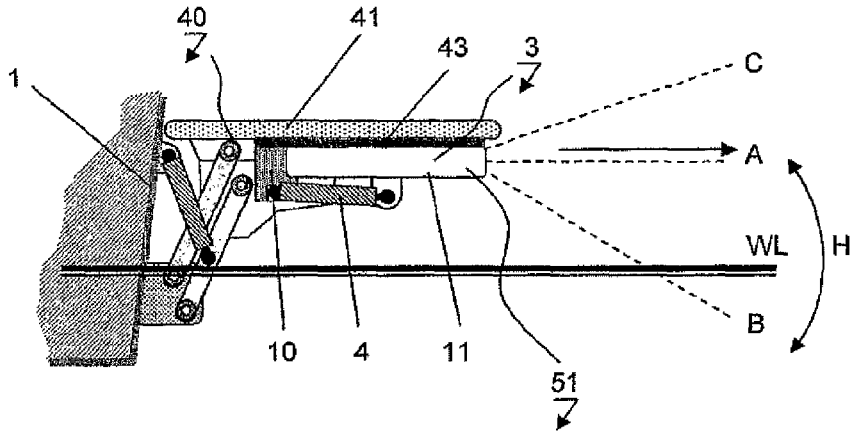

FIG. 10 Shows a schematic sideview of a segmented plate 2 which is placed under a height adjustable swimplatform 40 which can be extended and swivelled. The swimplatform plate 41 can be a standard platform or a plate 2 with the corresponding segmented strips 5. The plate 2, together with the console 10 usually fixed to the stern 1 and at this point ideally also with fixed cylinder 4, can be extended right up to the end of the swimplatform 40 by means of skid pads 43 and thereby substantially enlarge the walkable surface as well as using the additional swivel positions B and C.

Figure 11:
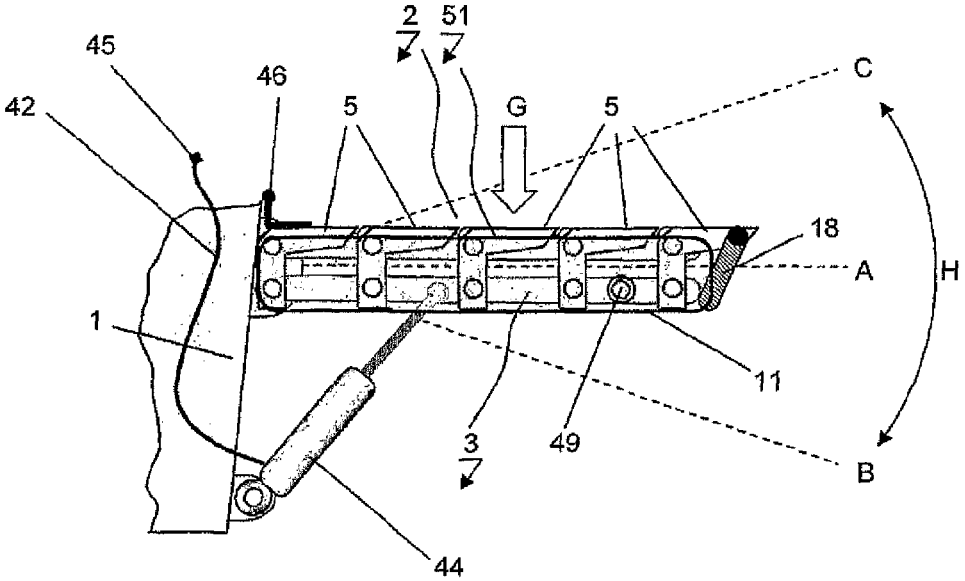

FIG. 11 Shows a schematic sideview of a segmented plate 2 with the releasable segmented strips 5 and the extendable part 18. The activation of the vario mean 3 takes place, instead of by means of a cylinder 4, over a blockable pressurised gas spring, called passive cylinder 44, which in any position can be swivelled and stopped and released again by means of a cable 42 or by means of a hydraulic unlocking device 45. The swivel change of the vario mean 3 takes place by means of weight load according to arrow G, respectively weight removal from plate 2, as here the exemplary selected passive cylinder 44 has been selected in the push out direction. Should a person wish to use the stair function and e.g. lower to the swivel position B, one uses its own body weight and activates the unlocking device 45 or the cable 42 so that the passive cylinder 44 gets compressed further and thus the vario mean 3 swivels downwards. Should the vario mean 3 be lifted up, in this case the person leaves the segmented strips 5 and presses the unlocking device 45 or the cable 42 and the vario mean 3 lifts up. In case the plate 2 is used as a gangway, the gangway locking device 46 is released enabling the vario mean 3 to be lifted up and e.g. reaching the swivel position C. By releasing the unlocking device 45, respectively the cable 42, the passive cylinder 44 is blocked in every desired swivel position and the person can then use it as a gangway. To bring the gangway position back again into a horizontal swivel position A, it is again the person's weight that compresses the passive cylinder, 44, whereby when in the horizontal position a one side stop function is automatically activated again, called gangway locking device 46, so that without a defined purpose the vario mean 3 cannot be lifted higher than into the horizontal position, i.e. into swivel position A. This is at the same time the standard position and similar in appearance and function to a normal swimplatform. Therefore the passive cylinder 44 has a standard support function for plate 2. As the lifting of vario mean 3 only functions by weight reduction, for cost reasons, one can have it without the release function of the segmented strips 5.

If two passive cylinders 44 are mounted on vario mean 3 and because passive cylinders 44 generally do not always show exactly the same push out speed—the same saying for cylinder 4—or compression effect and furthermore the weight distribution on plate 2 is seldom balanced, a torsion tube 49 is fixed between the swivel arms 9*b* in order to connect both of the swivel arms 9*a* and to stiffen as much as possible each other so that the best possible swivel flow harmonization of vario mean 3 takes place.

Of course the invention is not only applicable on shown and described examples

DRAWING LIST

1 stern
2 plate
3 vario mean
4 cylinder
5 segmented strip
6 rotation axis
7 cam
8 clip holder
9*a*,9*b* swivel arm
9*c*,9*d* pivot bearing
10 console
11 cover
12 stanchion
13 sensor
14 controller
15 foreign element
16 contact band
17 light strips
18 extendable part
19 flexible element
20 surface
21 segment
22 jumper switch
23 hinge
24 side cover
25 pressure spring
26 fin
27 quay
28 spring
29 over-pressure valve
30 hydraulic pump
31 active locking mechanism
31*a* passive locking mechanism
32 trigger
33 locking rod
34 locking mean
35 rail element
36 tender cart
37 carrying mean
38 sliding element
39 tender cart lock
40 swimplatform
41 swimplatform plate
42 cable
43 skid pad
44 passive cylinder
45 unlocking device
46 gangway locking device
47 spring loaded ball
48 ball pick up
49 torsion tube
50 lift locking mean
51 safety mean
52 trim indicator
53 alarm
WL waterline
H stroke
A,B,C swivel position
K power introduction
G weight
Z tender cart stroke

The invention claimed is:

1. A segmented plate for watercraft, the segmented plate comprising:

a console mounted behind a stern of the watercraft;

a plurality of swivel arms that form a parallelogram and are rotatably mounted to the console by a pivot bearing;

a plurality of segmented strips that are rotatably mounted to the swivel arms along a rotation axis, wherein each segmented strip has a cam that is held in a corresponding clip holder of the swivel arms;

a sensor that can detect a loss of contact between any one of the cams and the corresponding clip holder or a contact band mounted on each of the segmented strips; and a controller that receives a signal from the sensor or the contact band, wherein the controller triggers an alarm or stops movement of the swivel arms upon loss of contact between any one of the cams and the corresponding clip holder or if there is a predetermined pressure on the contact band.

2. The segmented plate according to claim 1, wherein the segmented strips or deformable elements on the segmented strips are lockable in a horizontal position by an active locking mechanism or a passive locking mechanism.

3. The segmented plate according to claim 1, wherein the segmented strips are releasable and may be automatically returned to an original position by a spring.

4. The segmented plate according to claim 1, wherein the sensor can detect the loss of contact between any one of the cams and the corresponding clip holder when the segmented strips are moved to a position in which the segmented strips are horizontally aligned.

5. The segmented plate according to claim 1, wherein the segmented strips have light strips.

6. The segmented plate according to claim 1, further comprising:

a jumper switch that allows movement of swivel arms even when there is a loss of contact between any one of the cams and the corresponding clip holder or if there is the predetermined pressure on the contact band.

7. The segmented plate according to claim 1, wherein the swivel arms are in an operative condition with a trim indicator.

8. The segmented plate according to claim 1, wherein the swivel arms are rotatable about the pivot bearing using a cylinder.

9. The segmented plate according to claim 1, wherein the segmented strips have deformable elements on one side of the segmented strips that deform from bottom to top under a load of a foreign element.

10. The segmented plate according to claim 1, wherein:

the swivel arms are rotatable about the pivot bearing using a cylinder, and the sensor or the contact band transmits the signal to the controller that stops the cylinder upon loss of contact between any one of the cams and the corresponding clip holder or if there is the predetermined pressure on the contact band.

11. The segmented plate according to claim 1, wherein:

the swivel arms are rotatable about the pivot bearing using a cylinder, and the cylinder is activated upon receipt of a signal from an overpressure valve to the controller.

12. The segmented plate according to claim 1, wherein:

the swivel arms are rotatable about the pivot bearing using a cylinder, and the cylinder may be switched in a pressureless manner or into a mechanical freewheel mode.

* * * * *